US008120535B2

(12) United States Patent
Hung et al.

(10) Patent No.: US 8,120,535 B2
(45) Date of Patent: Feb. 21, 2012

(54) MULTI-BAND ANTENNA WITH IMPROVED CONNECTING PORTION

(75) Inventors: Chen-Ta Hung, Tu-cheng (TW); Yun-Lung Ke, Tu-cheng (TW); Hsien-Sheng Tseng, Tu-cheng (TW)

(73) Assignee: Hon Hai Precision Ind. Co., Ltd, New Taipei (TW)

( * ) Notice: Subject to any disclaimer, the term of this patent is extended or adjusted under 35 U.S.C. 154(b) by 524 days.

(21) Appl. No.: 12/284,032

(22) Filed: Sep. 17, 2008

(65) Prior Publication Data

US 2009/0073052 A1 Mar. 19, 2009

(30) Foreign Application Priority Data

Sep. 17, 2007 (TW) ..... 96134664 A

(51) Int. Cl.
*H01Q 5/00* (2006.01)
*H01Q 1/38* (2006.01)

(52) U.S. Cl. ..... 343/700 MS; 343/845; 343/702

(58) Field of Classification Search ..... 343/718, 343/700 MS, 702, 844–846, 848, 872
See application file for complete search history.

(56) References Cited

U.S. PATENT DOCUMENTS 6,456,249 B1 * 9/2002 Johnson et al. ..... 343/702
6,819,287 B2 * 11/2004 Sullivan et al. ..... 343/700 MS
7,289,071 B2 10/2007 Hung et al.
7,362,277 B2 * 4/2008 Su ..... 343/702
7,405,701 B2 * 7/2008 Ozkar ..... 343/702
7,456,795 B2 * 11/2008 Chiba et al. ..... 343/702
7,466,272 B1 * 12/2008 Su et al. ..... 343/700 MS
2004/0046697 A1 * 3/2004 Tai et al. ..... 343/700 MS
2007/0030198 A1 * 2/2007 Wei ..... 343/700 MS
2007/0040754 A1 2/2007 Liu et al.
2007/0060222 A1 3/2007 Finn et al.
2007/0096999 A1 5/2007 Wang et al.
2008/0122717 A1 * 5/2008 Su et al. ..... 343/787
2008/0198087 A1 * 8/2008 Cheng et al. ..... 343/845

* cited by examiner

*Primary Examiner* — Jacob Y Choi
*Assistant Examiner* — Amal Patel
(74) *Attorney, Agent, or Firm* — Wei Te Chung; Andrew C. Cheng; Ming Chieh Chang

(57) ABSTRACT

A multi-band antenna includes a grounding element located on a first plane, a connecting element extending from the grounding element to form a slot between the connecting element and the grounding element, a conductive portion extending from the connecting element, a first radiating portion, a second radiating portion, and a third radiating portion. The first radiating portion is narrower than the conductive portion and extends from an end of the conductive portion along a first direction. The second radiating portion is connected to the first radiating portion and extends along a second direction opposite to the first direction. The third radiating portion is narrower than the first radiating portion and extends from an end of the connecting element.

2 Claims, 3 Drawing Sheets

MULTI-BAND ANTENNA WITH IMPROVED CONNECTING PORTION

BACKGROUND OF THE INVENTION

1. Field of the Invention

The present invention relates generally to a multi-band antenna, and more particularly to a multi-band antenna with single feeding point and multi radiating portions.

2. Description of the Prior Art

A present electric device always needs multi antennas for wireless communication. And in most designs, theses antennas are assembled in the inner space of the electric device. Thus, antennas used on different frequency bands are integrated together to reduce their volume.

U.S. Patent application Publication No. 2007/0040754 discloses an antenna structure integrating a first antenna of wireless wide area network (WWAN) and a second antenna of wireless local area network (WLAN), the same as U.S. Pat. No. 7,289,071, U.S. patent application Publication Nos. 2007/0060222, 2007/0096999, and so on. The two antennas respectively work as a single antenna but not influence to each other. However, some wireless communication criterions have common frequency band. For example, the center frequency under WLAN includes 2.4 GHz and 5 GHz and the frequency band under Worldwide Interoperability for Microwave Access (WiMax) includes 2.3-2.4 GHz, 2.5-2.7 GHz and 3.3-3.8 GHz, which overlaps the frequency bands under WLAN. Accordingly, an antenna integrated with a single WLAN antenna and a single WiMax antenna is not benefit for saving the inner space of the electric device.

Hence, in this art, a multi-band antenna to overcome the above-mentioned disadvantages of the prior art will be described in detail in the following embodiment.

BRIEF SUMMARY OF THE INVENTION

A primary object, therefore, of the present invention is to provide a multi-band antenna adapt to at least two types of network criterions.

In order to implement the above object and overcomes the above-identified deficiencies in the prior art, the multi-band antenna comprises a grounding element located on a first plane, a connecting element extending from the grounding element to form a slot between the connecting element and the grounding element, a conductive portion extending from the connecting element, a first radiating portion, a second radiating portion, and a third radiating portion. The first radiating portion is narrower than the conductive portion and extends from an end of the conductive portion along a first direction. The second radiating portion is connected to the first radiating portion and extends along a second direction opposite to the first direction. The third radiating portion is narrower than the first radiating portion and extends from an end of the connecting element.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
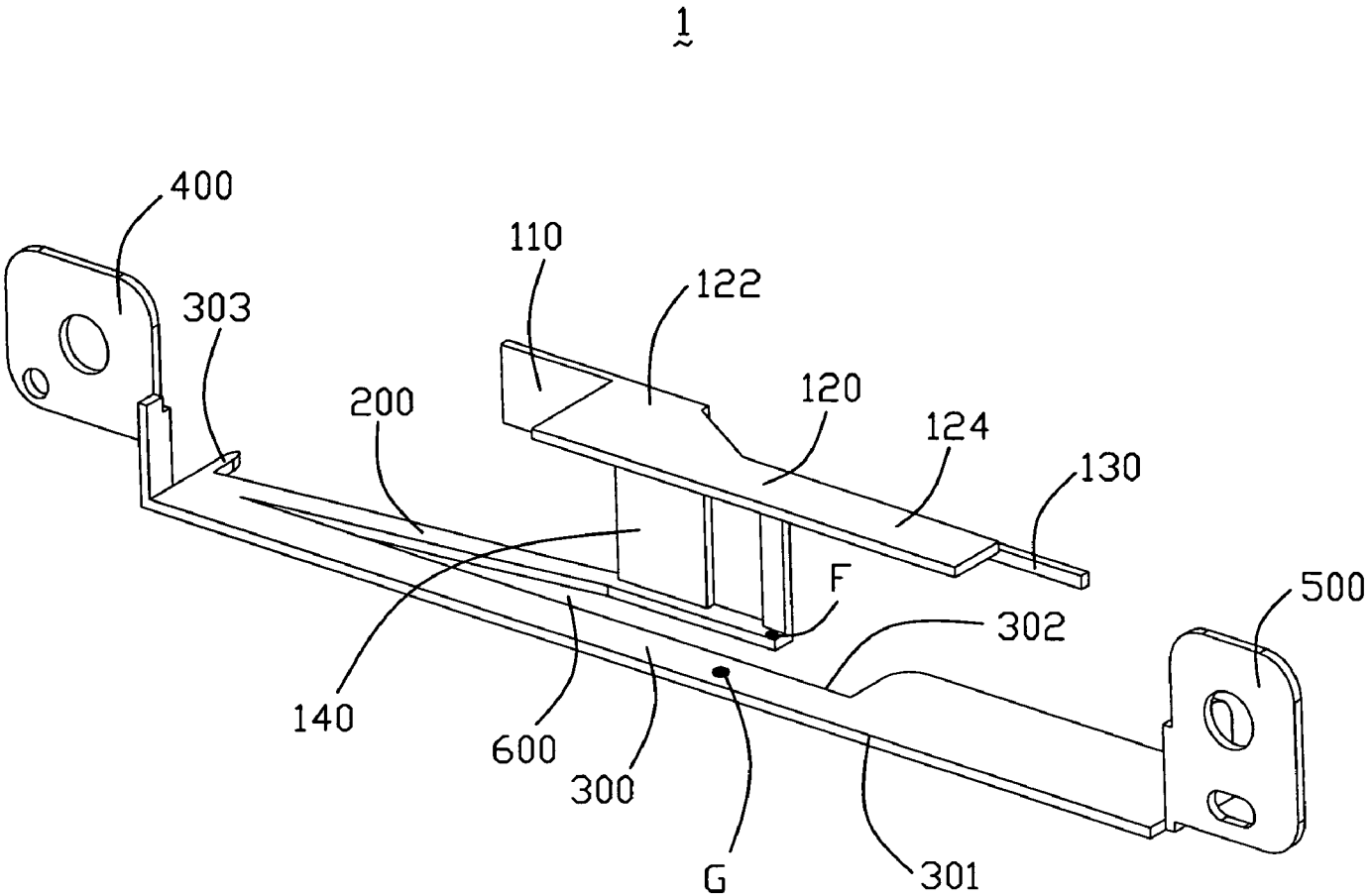
FIG. 1 is a perspective view illustrating a preferred embodiment of a multi-band antenna in according with the present invention.
Figure 2:
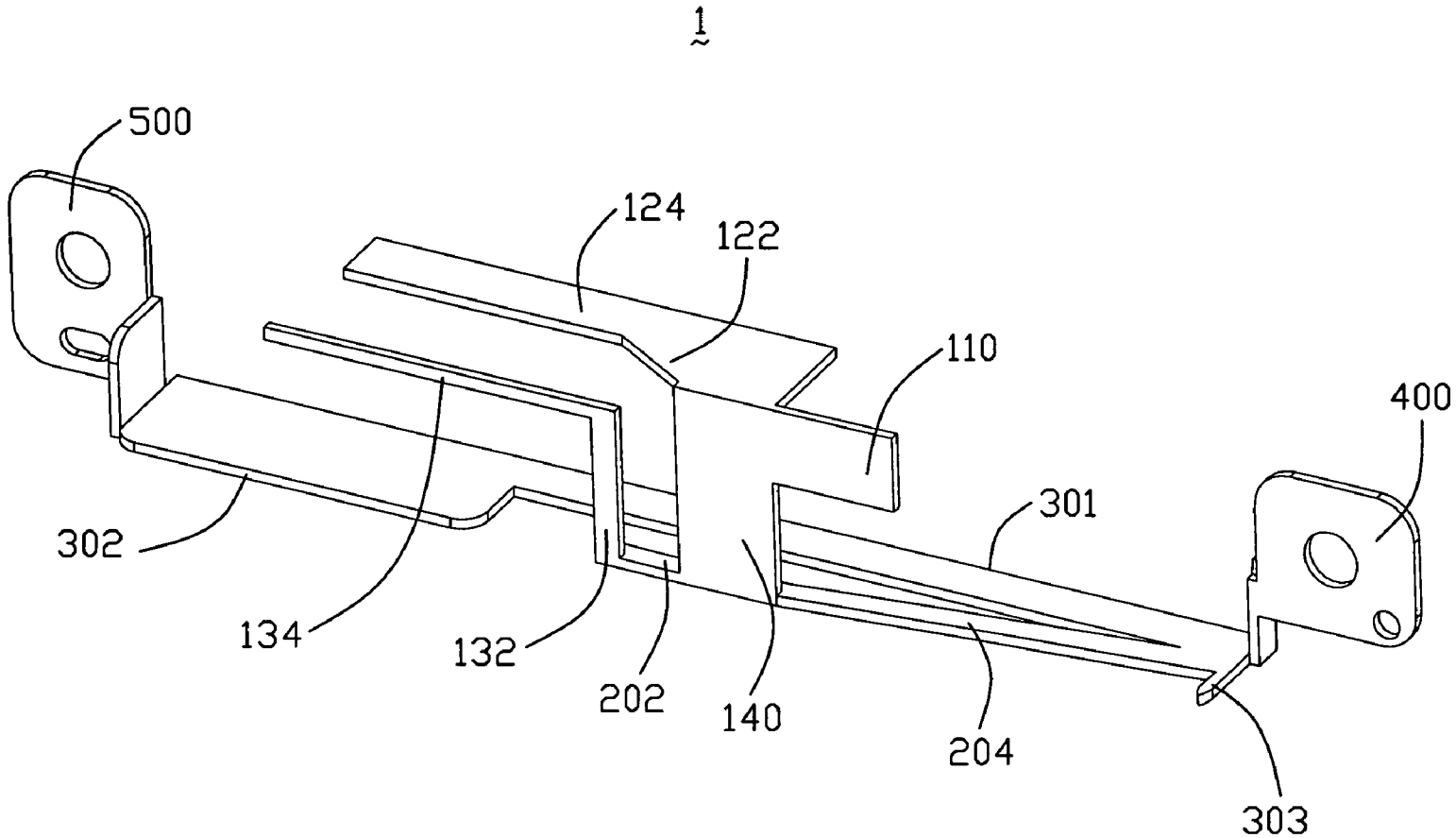
FIG. 2 is a perspective view of FIG. 1, but viewed from a different angle.

Reference to FIG. 1 and 2, a multi-band antenna 1 in accordance with a preferable embodiment of the present invention is shown. The multi-band antenna 1 is assembled in a notebook (not shown) and comprises a grounding element 300, a connecting element 200 extending from the grounding element 300, a conductive portion 140 upward and perpendicularly extending from the connecting element 200, a first radiating portion 110, a second radiating portion 120 and a third radiating portion 130. The first radiating portion 110 and the second radiating portion 120 respectively extend from the conductive portion 140. The third radiating portion 130 extends from the connecting element 200.

The grounding element 300 is located on a first plane. A first setting portion 400 and a second setting portion 500 respectively extends from the two ends of grounding element 300 to fix the multi-band antenna 1 in the notebook. The multi-band antenna 1 can be assembled on any side of display of the notebook. The grounding element 300 comprises a rectilineal first side 301, a Z-shape second side 302 and a side arm 303 extending from the second side 302 to further fix the multi-band antenna 1.

The connecting element 200 extends from the joint of the second side 302 and the side arm 303 to form a slot 600 between the connecting element 200 and the grounding element 300. The connecting element 200 is also located on the first plane and comprises a first section 204 extending from the grounding element 300 to form an angle and a second section 202 extending from the first section 204 and parallel to the first side 301 to form a beginning portion and an end.

The conductive portion 140 is of rectangular configuration and upwardly and perpendicularly extends from the beginning portion of the second section 202 of the connecting element 200 to be located on a second plane.

The first radiating portion 110 is of rectangular configuration and located on the second plane. The first radiating portion 110 perpendicularly extends from a first side of the conductive portion 140 along a first direction. The second radiating portion 120 comprises a trapeziform first piece 122 extending from the upper surface of the first radiating portion and a second rectangular second piece 124 extending from the first piece 122 along a second direction opposite to the first direction. The second radiating element 120 is located on a third plane which is parallel to the first plane and perpendicular to the second plane. The third radiating portion 130, which is on the free end of the second section 202, is of plane L shape on the second plane. The third radiating portion 130 comprises a first radiating arm 132 upward perpendicularly extends from the first side of the second section 202 and a second radiating arm 134 perpendicularly extending from the first radiating arm 132 along the second direction. The third radiating portion 130 is lower than the second radiating portion 120.

A feeding point F is formed on the free end of the radiating portion 130 to be connected to an inner conductor of a feeding line (not shown). A grounding point G is formed on the grounding element 300 to be connected to an outer conductor of the feeding line (not shown).

Figure 3:
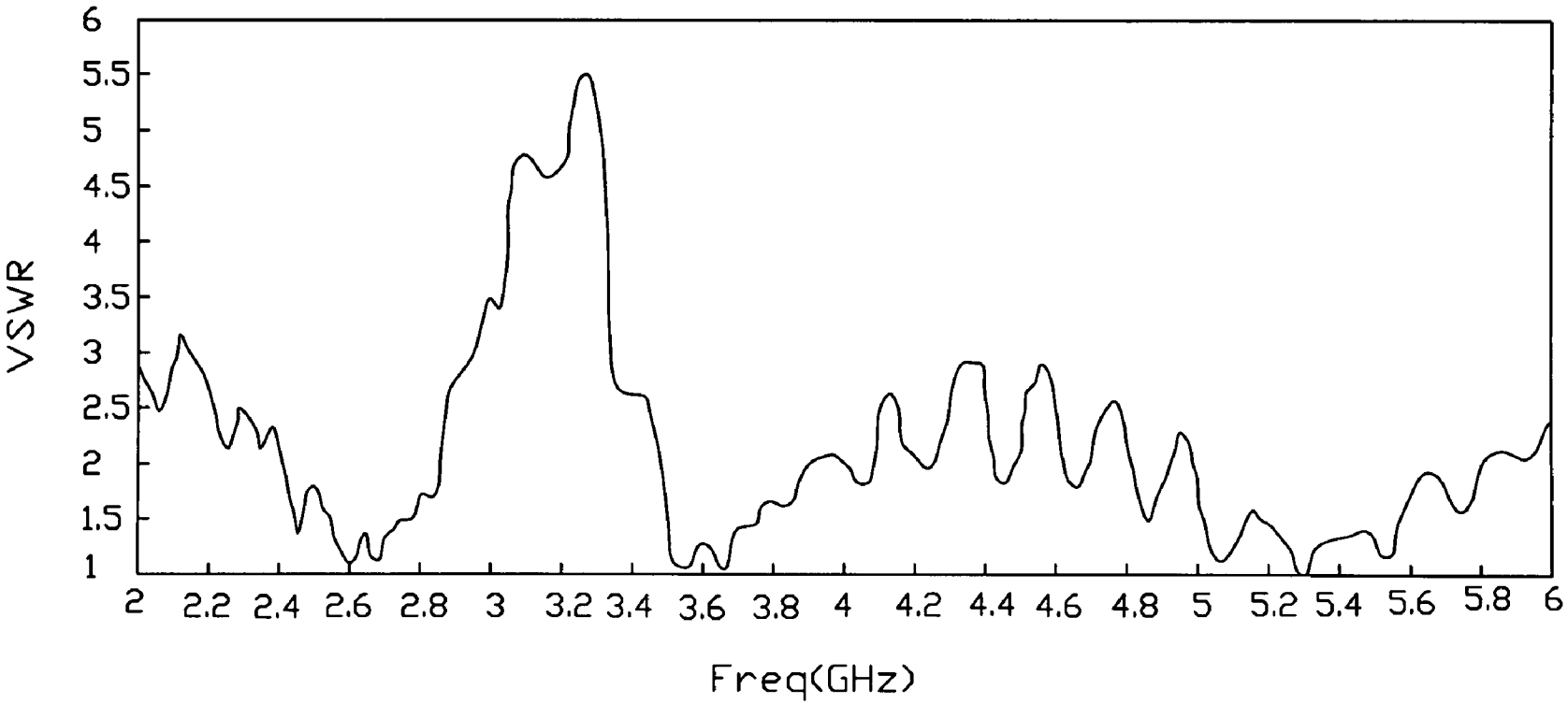
FIG. 3 is a test chart recording for the multi-band antenna of FIG. 1, showing Voltage Standing Wave Ratio (VSWR).

The conductive portion 140 is wider than the first radiating portion 110. The third radiating portion 130 is narrower than both the first radiating portion 110 and the second radiating portion 120. Because of the wide conductive portion 140, the working band width both of the first radiating portion 110 and the second radiating portion 120 achieve 400 MHz. FIG. 3 shows the VSWR view of the multi-band antenna 1. The first radiating portion 110 is used to receive and send signals on a higher frequency band of 4.9-5.8 GHz, the second radiating portion 120 works at a lower frequency band of 2.3-2.7 GHz, and the third radiating portion resonates on a frequency band of 3.3-3.8 GHz. Thus, the multi-band antenna 1 is obviously adapted to the requests of WLAN and WiMax.

While the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

What is claimed is:

1. A multi-band antenna comprising:

a grounding element extending along a longitudinal direction;

a connection element extending from the grounding element essentially along an oblique direction with a free end region thereof so as to form a slot between the grounding element and the connection portion;

a conductive portion extending from a first position of said free end region and defining a distal end zone thereof;

a first radiation portion extending from the distal end zone of the conductive portion in a first direction along said longitudinal direction;

a second radiation portion extending form the distal end zone of the conductive portion in a second direction opposite to the first direction; and a third radiation portion extending from a second position of the free end region; wherein a feeder cable including an inner conductor connected to the free end region, and an outer conductor connected to the grounding portion; wherein the third radiation portion is spaced from the conductive portion with a distance defined between said first position and said second position; wherein the grounding element and the connection element are located in a first plane, the conductive portion and the third radiation portion are located in a second plane perpendicular to said first plane, and the first radiation portion is located in the second plane while the second radiation portion is located in a third plane parallel to said first plane.

2. The multi-band antenna as claimed in claim 1, wherein the free end region is essentially parallel to the grounding element and oblique to the connection portion.

* * * * *